United States Patent [19]

Stukel et al.

[11] 3,933,626

[45] Jan. 20, 1976

[54] CLASSIFIER FOR PARTICULATE MATERIAL

[75] Inventors: James Stukel; Robert G. Rentz, both of Ottawa, Ill.

[73] Assignee: Ottawa Silica Company, Ottawa, Ill.

[22] Filed: July 12, 1973

[21] Appl. No.: 379,004

[52] U.S. Cl. ..... 209/134; 209/142

[51] Int. Cl. ..... B07b 4/02

[58] Field of Search ..... 209/134–137, 209/156, 32, 33, 142, 143

[56] References Cited

UNITED STATES PATENTS

| | | | |
|---|---|---|---|
| 197,897 | 12/1877 | Rice | 209/135 |
| 447,027 | 2/1891 | Hallowell | 209/142 |
| 494,800 | 4/1893 | Shumaker | 209/135 |
| 601,728 | 4/1898 | Case | 209/139 R X |
| 775,965 | 11/1904 | Edison | 209/135 |
| 1,042,836 | 10/1912 | Stromborg | 209/135 |
| 1,491,429 | 4/1924 | Stebbins | 209/135 |
| 3,098,781 | 7/1963 | Greten | 209/134 |

FOREIGN PATENTS OR APPLICATIONS

| | | | |
|---|---|---|---|
| 545,573 | 10/1922 | France | 209/135 |

*Primary Examiner*—Frank W. Lutter
*Assistant Examiner*—Ralph J. Hill
*Attorney, Agent, or Firm*—Hofgren, Wegner, Allen, Stellman & McCord

[57] ABSTRACT

A classifier for particulate material of the type wherein a stream of the particles to be classified is introduced into a moving stream of air, classification being achieved by the varying degree of entrainment of the particles in the air stream due to their difference in size. The classifier employs a closed housing having a plurality of outlets, each for a different size of particle, and an inlet located thereabove. An air impeller drives a current of air across the particle outlets. The housing is closed so that the air defining the stream is continuously recirculated. At a point in the air stream downstream of the outlets there is provided an enlarged chamber through which the air flows at an extremely low velocity to preclude particles from being entrained in the air to be carried back to the air impeller.

5 Claims, 1 Drawing Figure

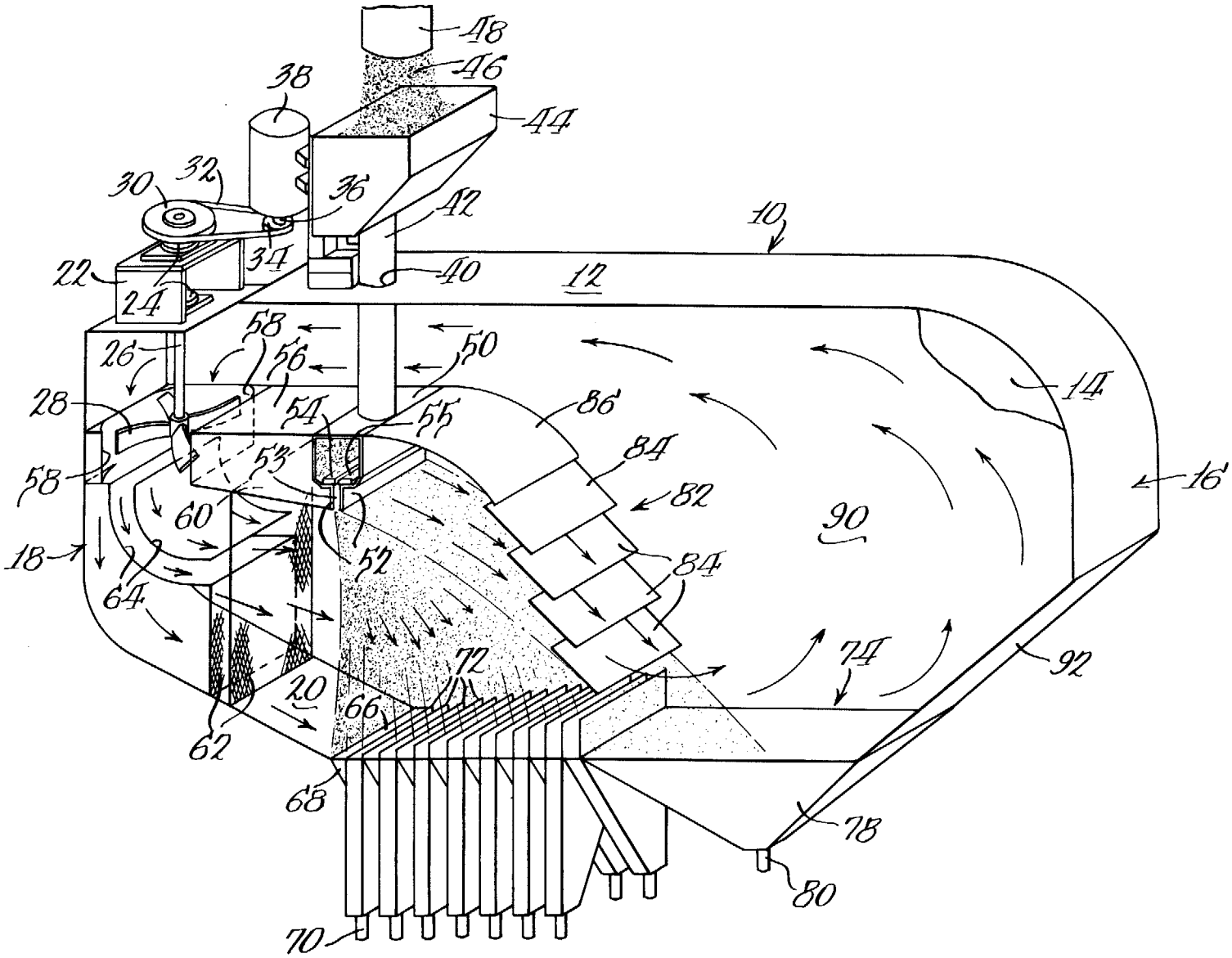
10
12
14
16
18
20
22
24
26
28
30
32
34
36
38
40
42
44
46
48
50
52
54
56
58
60
62
64
66
68
70
72
74
76
78
80
82
84
86
90
92

CLASSIFIER FOR PARTICULATE MATERIAL

BACKGROUND OF THE INVENTION

This invention relates to classifiers for particulate material and, more particularly, to classifiers of the type wherein particles are distributed to various collection points by entrainment in a moving current of air.

Representative prior art includes the following U.S. Pat. Nos.: Rice 197,897; Frink 248,584; Davidson 527,835; Edison 775,965; Stromborg 1,042,836; Stebbins 1,759,959; Stebbins 1,834,981; Cowher 2,978,103; and Murphy 3,385,436.

A variety of industries require the use of classifiers for particulate material in their operations. Most particulate material classifiers fall into either of two general categories. The first general category employs the use of screens which, in many instances, are sufficient for a particular type of job. However, where a high throughput of material to be classified is required, screen type classifiers are impractical.

The second basic type of classifier is one which classifies by entraining particles in an air stream. Heavier particles are less likely to be substantially entrained than lighter particles and classification is thus achieved by taking advantage of this fact. Air stream classifiers have the advantage over screen classifiers of handling far greater amounts of material.

However, most air stream classifiers in use today are not without their disadvantages. In many instances, the particulate material to be treated will contain substantial fines that will not drop out of the air stream at the endmost classifying stage. As a result, in many instances, such fines are discharged into the environment with the exhaust from the air stream thereby causing an air pollution problem.

Attempts have been made to eliminate the air pollution problem by recirculating the air. The above identified Murphy patent is representative of this approach. However, where the particulate material is relatively hard as, for example, sand, the fines mentioned above are recirculated through an air impelling device and may cause rapid deterioration of the same due to abrasive contact therewith. Thus, such equipment requires substantial maintenance.

SUMMARY OF THE INVENTION

It is the principal object of the invention to provide a new and improved air classifier for particulate material. More specifically, it is an object of the invention to provide such a classifier wherein entrained fines are not discharged into the environment and wherein provision is made to minimize the entrainment of fines so as to enhance the longevity and maintenance-free life of the classifier.

The exemplary embodiment achieves the foregoing objects in an apparatus including a generally horizontally elongated, substantially closed housing having upper, lower, side and end walls. Intermediate the ends of the bottom wall, there is provided a plurality of individual outlets which extend transversely of the housing between the side walls and which are arranged serially in the direction of elongation thereof. An air impelling device is located within the housing adjacent one end thereof and is operable to direct air from that end toward the other end across the particulate material outlets.

A material inlet is also located within said housing and includes an elongated metering orifice within the housing which extends transversely of the housing and through which particulate material may be introduced into the housing. The orifice is on the lower end of a manifold which, in turn, is connected via a pipe to the exterior of the housing so as to establish a "head" of particulate material to promote uniformity of flow of material into the housing. The orifice is located directly above or upstream of the nearest particle outlet so that particulate material flowing therefrom will be entrained in a current of air generated by the air impeller with the heavier particles dropping more directly downwardly under the influence of gravity than the lighter particles to achieve classification.

To promote uniformity of classification, means are located between the air impeller and the particle inlet to provide a laminar flow condition in the air stream across the particle outlets. In the exemplary embodiment, screens are employed for this purpose.

Downstream of the inlet, there is provided a baffle means for directing the lightest particles toward the endmost particle outlet to minimize entrainment thereof. In addition, downstream of the last particle outlet is an enlarged chamber through which the air stream flows. Because of the enlargement of the chamber, the velocity of the air flow therethrough is relatively minimal, allowing the lightest particles to drop out of the air stream. Means are associated with the chamber for directing such particles to the last particle outlet.

An air path is also established between the chamber and the air impeller to provide for recirculation within what amounts to an essentially sealed housing to preclude the discharge of entrained material into the surrounding atmosphere.

Other objects and advantages will become apparent from the following specification taken in conjunction with the accompanying drawings.

DESCRIPTION OF THE DRAWING

The FIGURE is a perspective view of a particle classifier made according to the invention with one side wall totally broken away for clarity.

DESCRIPTION OF THE PREFERRED EMBODIMENT

An exemplary embodiment of a particulate material classifying apparatus made according to the invention is illustrated in the Figure and is seen to include a generally closed housing, generally designated 10, including an upper wall 12, a pair of side walls 14 (only one of which is shown), a means, generally designated 16, defining one end wall, a means, generally designated 18, defining an opposed end wall, and a bottom wall 20.

Mounted on the exterior surface of the upper wall 12, near the end 18, is a frame 22 mounting bearings 24 which journal a shaft 26 for rotation about a substantially vertical axis. The shaft 26 is elongated and extends into the interior of the housing 10 to mount an air impelling blade 28. The upper end of the shaft 26 mounts a sheave 30 about which is trained a belt 32. The belt 32 is also trained about a sheave 34 on the output shaft 36 of a drive motor 38. As a result of the foregoing construction, when the drive motor 38 is energized, the impeller 28 will be rotated to establish a current of air which follows a path to be described hereinafter within the housing 10.

The upper wall 12 of the housing 10 also includes an opening 40 through which a conduit 42 sealingly passes. The upper end of the conduit 42 terminates in a hopper 44 into which particulate material 46 may be received from any suitable source, schematically indicated at 48. The lower end of the conduit 42 within the housing 10, and substantially below the inner surface of the upper wall 12, terminates in an elongated manifold 50 which, as can be seen, is oriented generally transverse to the direction of elongation of the housing 10 and is generally horizontal. The manifold 50, at its lower end, includes downwardly projecting, spaced lips 52 defining a particle passage 53. Above the latter and within the manifold 50 is a removable orifice plate 54 having an elongated metering slot 55 which is elongated transversely of the housing 10 and aligned with the passage 53. As a result, a uniform stream of particulate material may be introduced across the interior of the housing. By changing the plate 54 to a similar plate having a wider or narrower slot 55, the flow rate may be appropriately regulated.

The provision of the manifold 50, conduit 42 and hopper 44 allows particulate material 46 to be held in the apparatus sufficiently as to establish a "head" of material above the metering slot 55 to promote uniformity of flow of the material therethrough in much the same manner as liquid flow is controlled. The head also seals the inlet precluding air from being drawn into the housing thereby precluding the exhausting of air from the housing through the outlets thereof.

A flow path defining member 56 is located within the housing 10 as substantially an extension of the upper surface of the manifold 50 and is directed toward the end 18 of the housing 10 in the general proximity of the impeller 28. Curved baffles 58 are located about the impeller 28 for the usual purposes.

Below the plate 56 is a similar plate 60 which joins with substantially the lower end of the lip 52 nearest the housing end 18. Interposed between the plate 60 and the bottom wall 20 of the housing 10, are one or more screens 62. Between the screens 62 and the impeller are one or more curved air flow directing baffles 64. The overall arrangement is such that when the motor 38 is energized, air will be drawn across the plate 58 and directed by the impeller 28 across the baffles 64 and through the screens 62. The latter serve to establish a laminar flow condition in the current of air after the same has passed through the screen 62 to encounter particulate material flowing through the slot 55. That is, the screens 62 substantially eliminate turbulence in the air stream to promote accurate classification.

Downstream of the screens 62 and the slot 55 are a plurality of particle outlets. The same are arranged transverse to the elongated dimension of the housing 10 and serially intermediate the ends thereof. A first of the particle outlets is designated 66 and will receive the coarsest particles being classified. By means of formed metal ducting 68, the particles received in the outlet are directed to the corresponding outlet tube 70 from which the sized particles may be taken and applied to that ultimate use.

As can be observed from the FIGURE, upwardly extending plates of progressively increased length 72 are associated with the downstream side of each of the outlets 66 going from the end wall 18 toward the end wall 16. This, in effect, increases the effective size of the particle receiving opening of each of the particle outlets 66 while in essence canting the opening in the general direction of the slot 55.

As illustrated, fifteen of the particle outlets 66 are provided, although a greater or lesser number could be used. A sixteenth outlet is generally designated 74 and has an effective particle receiving area many times that of a given one of the outlets 66. The outlet 74 is intended to receive the finest of the particles introduced through the orifice 54. The outlet 74 may be defined by an inverted pyramid-shaped sheet metal structure 78 terminating in an outlet tube 80. To the upstream side of the outlet 74 there is provided a baffle means, generally designated 82, for directing the air stream, after it has passed the downstream most one of the outlets 66, toward the outlet 74.

In the exemplary embodiment, the baffle means 82 are arranged as a plurality of plates 84 in a louver-like formation. The plates 84, in connection with a plate 86, extending to the upper surface of the manifold 50 together with the side walls 14, that portion of the upper wall 12 adjacent the end wall 16 and the end wall 16, define an enlarged chamber 90. The chamber 90 is, as is apparent from the FIGURE, downstream of the particle outlets 66 and 74 and because of the substantial enlargement in its size over the remainder of the flow path for the air, it will be appreciated that air in the chamber 90 will be moving at an extremely low velocity such that even extreme fines are free to drop out of entrainment in the air stream into the outlet 74. To assist in this function, the end wall 16 may include a diagonal section 92 which acts as a chute for the fine material to direct the same to the outlet 74.

It will be appreciated from the foregoing description of the exemplary embodiment of the invention that a classifier made according to the invention provides reliable, accurate, high capacity classification of particulate material such as sand. It will also be recognized that by reason of the air circulation path, entrained fines are not discharged into the environment to cause a pollution problem. Moreover, by reason of the provision of the enlarged chamber 90, the entrainment of fines in the return path for the air to the impeller is virtually eliminated. As a result, where abrasive materials, such as sand, are being classified, the equipment will be relatively maintenance free and long-lived since abrasive contact with the impeller 28 is virtually eliminated.

A classifier made according to the invention is ideally suited for ganging in multiples of the housings 10 in side-by-side relationship. When more than one of the housings are employed in a ganged relationship, one of the motors 38 may drive two or more of the impellers 28. In such a case, a single orifice plate 55 having a length sufficient to extend through all of the side-by-side housings may be employed, leakage about such an orifice plate being negligible by reason of the seal provided by the head of particulate material as mentioned previously.

We claim:

1. A particle classifier comprising: a generally closed housing having an inlet through which particulate material may be introduced into the housing for classification purposes and a plurality of outlets located below said inlet and in serial fashion extending along one boundary of said housing, said outlets being to one side of said inlet; means within said housing on the other side of said inlet for forcing a current of air across said inlet to said one side thereof for entraining particles introduced into said housing through said inlet whereby heavier particles will be received in outlets nearer to said inlet and light particles will be carried to outlets further from said inlet; means within said housing defining a flow path for air from said inlet one side to said inlet other side whereby said means for forcing a current of air is operative to continuously circulate air within said housing; and means within said flow path between said current of air forcing means and said further outlets defining an enlarged expansion chamber through which the current of air passes at a relatively low velocity so as to substantially preclude entrainment of the lightest ones of the particles introduced into said inlet back to said current of air forcing means, said chamber defining means including louvers for directing said current of air toward an outlet remote from said inlet.

2. Particle classifying apparatus according to claim 1 wherein said inlet comprises a manifold extending across said housing and having an elongated opening through which particles may pass into said housing and means for delivering particulate material to be classified to said manifold to establish a head of particulate material in said manifold above said opening including an upright conduit in communication with said manifold and hopper means mounted on said conduit.

3. Air classifying apparatus for particulate material comprising: a generally horizontally elongated, substantially closed housing having an upper side, a bottom side, a pair of side walls, and means defining end walls; means in said bottom wall intermediate the ends thereof defining a plurality of individual particle outlets, said outlets extending transversely of said housing and being arranged serially in the direction of elongation thereof; an air impelling device located within said housing adjacent one end thereof and operable to direct air from said one end toward the other end across said particle outlets; a particulate material inlet within said housing including an elongated metering orifice within said housing extending transversely of said housing through which particulate material may be introduced into said housing, said orifice being located directly above or upstream of the particulate outlet nearest said housing one end so that particulate material flowing therefrom will be entrained in a current of air generated by said air impelling device with the heavier particles dropping more directly downwardly under the influence of gravity than the lighter particles; means downstream of said impeller and upstream of said orifice for establishing a laminar air flow characteristic in the current of air generated by said air impeller prior to the impingement of said current of air on a stream of particles emanating from said orifice; light particle directing means within said housing for directing extremely light particles entrained in said current of air toward at least the particle outlet nearest the other end of said housing; and said housing including an enlarged chamber downstream of said particle outlet nearest said other end, said chamber being sufficiently large that a current of air passing therethrough is at a relatively low velocity to substantially preclude particles entrained in said current of air from passing through said chamber; means associated with said chamber for directing particles entrained in air reaching said chamber toward one of said particle outlets; and means associated with said chamber for redirecting air therefrom toward said air impelling device to define a closed air circulation path.

4. Air classifying apparatus for particulate material comprising: a generally horizontally elongated, substantially closed housing having an upper side, a bottom side, a pair of side walls, and means defining end walls; means in said bottom wall intermediate said end walls defining a plurality of individual particle outlets, said outlets being arranged serially in the direction of elongation of said housing; means associated with said housing for directing a current of air from one end thereof toward the other end thereof across said particle outlets; a particulate material inlet within said housing through which particulate material may be introduced into said housing, said inlet being located directly above or upstream of the particulate outlet nearest said housing one end so that particulate material flowing therefrom will be entrained in said current of air when said air directing means is operating with the heavier particles dropping more directly downwardly under the influence of gravity than the lighter particles; said housing further including an enlarged chamber adjacent said other end and downstream of said particle outlet nearest said other end, said chamber being sufficiently large so that said current of air after passing of said particle outlets at a relatively high velocity will move within said chamber at a relatively low velocity to substantially preclude particles entrained in said current of air from passing through said chamber; means associated with said chamber for directing particles coming out of entrainment in said current of air within said chamber to one of said particle outlets; and means establishing a closed air flow path from said chamber to said housing one end; said means for directing particles comprising louvers overlying at least some of said outlets, said louvers being directed to cause said current of air to flow downwardly towards said one particle outlet.

5. An air classifying apparatus according to claim 4 wherein said means defining a closed flow path is located wholly within said housing.

* * * * *